US007350249B2

(12) United States Patent
Jacobs et al.

(10) Patent No.: US 7,350,249 B2
(45) Date of Patent: Apr. 1, 2008

(54) LEG REST AND KNEELER ASSEMBLY FOR A MEDICAL EXAMINATION TABLE

(75) Inventors: Jerry J. Jacobs, Delafield, WI (US); Jack A. DeBraal, Plymouth, WI (US); Mark E. Jensen, Sheboygan, WI (US)

(73) Assignee: The Brewer Company, LLC, Menomonee Falls, WI (US)

( * ) Notice: Subject to any disclaimer, the term of this patent is extended or adjusted under 35 U.S.C. 154(b) by 104 days.

(21) Appl. No.: 10/953,479

(22) Filed: Sep. 29, 2004

(65) Prior Publication Data

US 2005/0102755 A1 May 19, 2005

Related U.S. Application Data

(60) Provisional application No. 60/506,989, filed on Sep. 29, 2003.

(51) Int. Cl.
*A47C 7/50* (2006.01)

(52) U.S. Cl. ..... 5/624

(58) Field of Classification Search ..... 5/600, 5/613, 618, 621, 624; 297/423.19, 423.32, 297/423.36

See application file for complete search history.

(56) References Cited

U.S. PATENT DOCUMENTS

| | | | |
|---|---|---|---|
| 487,625 | A | 12/1892 | Kales |
| 488,649 | A | 12/1892 | Daggett |
| 542,060 | A | 7/1895 | Lentz |
| 1,039,708 | A | 10/1912 | Denquer |
| 1,650,327 | A | 11/1927 | Conrad |
| 1,684,889 | A | 9/1928 | Russ |
| 1,891,629 | A | 12/1932 | Van Wagner |
| 1,967,422 | A | 7/1934 | Nadelson |
| 2,120,732 | A | 6/1938 | Comper et al. |
| 2,267,973 | A | 12/1941 | Demcak |
| 2,272,819 | A | 2/1942 | Poetsch et al. |
| 2,306,031 | A | 12/1942 | Anderson et al. |
| 2,538,993 | A | 1/1951 | Travis |
| 2,565,784 | A | 8/1951 | Sheean |
| 2,605,151 | A | 7/1952 | Shampaine |
| 2,606,801 | A | 8/1952 | Shampaine |
| D170,305 | S | 9/1953 | Claus |
| 2,652,887 | A | 9/1953 | Fitzgerald |
| 2,659,902 | A | 11/1953 | Fitzgerald et al. |
| 2,679,445 | A | 5/1954 | Roehm |
| 2,682,671 | A | 7/1954 | Faure |
| 2,788,529 | A | 4/1957 | Moritzacky et al. |
| 2,801,142 | A | 7/1957 | Adams |
| 2,941,215 | A | 6/1960 | Johnson |
| 3,016,275 | A | 1/1962 | Grant |
| 3,041,121 | A | 6/1962 | Comper |

(Continued)

*Primary Examiner*—Patricia Engle
*Assistant Examiner*—Fredrick Conley
(74) *Attorney, Agent, or Firm*—Ryan Kromholz & Manion, S.C.

(57) ABSTRACT

A leg rest assembly for an examination table that is adaptable to extend the length of the table or to act as a kneeler section is disclosed. The extension section of the assembly has an efficient design that allows for the assembly to be easily changed from an extension section to a kneeler. A latching mechanism to hold the assembly in an extended position outwardly from the table is designed separately from the guide mechanism that move the assembly into a kneeler configuration.

9 Claims, 8 Drawing Sheets

U.S. PATENT DOCUMENTS

| | | | |
|---|---|---|---|
| 3,100,129 | A | 8/1963 | Adolphson |
| D202,963 | S | 11/1965 | Dailey |
| 3,215,834 | A | 11/1965 | Tayman |
| D204,222 | S | 3/1966 | Dailey |
| 3,281,141 | A | 10/1966 | Smiley et al. |
| D207,081 | S | 2/1967 | Katzfey et al. |
| D207,483 | S | 4/1967 | Dottinger |
| 3,334,951 | A | 8/1967 | Douglas, Jr. et al. |
| 3,348,893 | A | 10/1967 | Katzfey et al. |
| 3,355,163 | A | 11/1967 | Leinassar |
| 3,409,287 | A | 11/1968 | Chervenka |
| 3,411,766 | A | 11/1968 | Lanigan |
| 3,413,663 | A | 12/1968 | Swann |
| 3,452,977 | A | 7/1969 | Ryman |
| 3,499,529 | A | 3/1970 | Katzfey et al. |
| D217,646 | S | 5/1970 | Sherer |
| 3,638,935 | A | 2/1972 | Lelugas et al. |
| 3,658,317 | A | 4/1972 | Bartlett et al. |
| 3,724,004 | A | 4/1973 | Behrens |
| 3,754,749 | A | 8/1973 | Lyon et al. |
| 3,814,414 | A | 6/1974 | Chapa |
| 3,817,512 | A | 6/1974 | Torrey |
| 3,851,870 | A | 12/1974 | Cook |
| 3,868,103 | A | 2/1975 | Pageot et al. |
| 3,905,591 | A | 9/1975 | Schorr et al. |
| 3,944,205 | A | 3/1976 | Mueller |
| 3,947,686 | A | 3/1976 | Cooper et al. |
| 3,967,128 | A | 6/1976 | Smulewicz |
| 3,997,792 | A | 12/1976 | Conrad et al. |
| 4,003,704 | A | 1/1977 | Zurolo et al. |
| 4,034,972 | A | 7/1977 | Peterson |
| D245,287 | S | 8/1977 | Damico et al. |
| 4,045,078 | A | 8/1977 | Shine |
| 4,057,240 | A | 11/1977 | Damico et al. |
| 4,076,230 | A | 2/1978 | Pike |
| D250,043 | S | 10/1978 | Shine |
| 4,148,472 | A | 4/1979 | Rais et al. |
| 4,168,099 | A | 9/1979 | Jacobs et al. |
| 4,180,002 | A | 12/1979 | Huempfner |
| 4,183,596 | A | 1/1980 | Greene et al. |
| 4,186,917 | A | 2/1980 | Rais et al. |
| 4,221,371 | A | 9/1980 | Kuphal |
| 4,284,268 | A | 8/1981 | Gauthier |
| 4,287,422 | A | 9/1981 | Kuphal et al. |
| D263,777 | S | 4/1982 | Thompson |
| 4,322,899 | A | 4/1982 | Clune |
| D265,241 | S | 6/1982 | Patterson |
| D265,242 | S | 6/1982 | Patterson |
| D266,023 | S | 8/1982 | McLachlan |
| D266,765 | S | 11/1982 | Clune |
| 4,383,351 | A | 5/1983 | Fenwick |
| 4,407,687 | A | 10/1983 | Mitchell |
| 4,464,780 | A | 8/1984 | Ruiz |
| 4,501,414 | A | 2/1985 | Mason et al. |
| 4,506,872 | A | 3/1985 | Westerberg et al. |
| 4,508,387 | A | 4/1985 | Gilbert et al. |
| D278,668 | S | 5/1985 | Simpkins |
| 4,516,805 | A | 5/1985 | Leeper et al. |
| 4,529,185 | A | 7/1985 | Gutierres |
| 4,540,165 | A | 9/1985 | Green et al. |
| 4,545,628 | A | 10/1985 | Richey |
| 4,547,092 | A | 10/1985 | Vetter et al. |
| 4,552,403 | A | 11/1985 | Yindra |
| 4,557,471 | A | 12/1985 | Pazzini |
| 4,558,857 | A | 12/1985 | Heller |
| D282,398 | S | 1/1986 | Yindra |
| 4,586,398 | A | 5/1986 | Yindra |
| 4,586,762 | A | 5/1986 | Kennedy et al. |
| 4,589,124 | A | 5/1986 | Ruiz |
| 4,589,642 | A | 5/1986 | Schnelle et al. |
| 4,600,248 | A | 7/1986 | Pflieger |
| 4,602,756 | A | 7/1986 | Chatfield |
| 4,606,575 | A | 8/1986 | Kodet |
| 4,608,812 | A | 9/1986 | Willson |
| D286,481 | S | 11/1986 | Case et al. |
| 4,653,129 | A | 3/1987 | Kuck et al. |
| 4,665,574 | A | 5/1987 | Filips et al. |
| 4,667,354 | A | 5/1987 | Carey, Jr. et al. |
| 4,667,605 | A | 5/1987 | Bastian |
| 4,691,393 | A | 9/1987 | Kuck |
| 4,700,916 | A | 10/1987 | Bastian et al. |
| 4,716,840 | A | 1/1988 | Tringali et al. |
| 4,717,102 | A | 1/1988 | Pflieger |
| 4,732,089 | A | 3/1988 | Mueller |
| 4,732,430 | A | 3/1988 | Byrns |
| 4,750,305 | A | 6/1988 | Bastian |
| 4,752,977 | A | 6/1988 | Smith et al. |
| 4,761,000 | A | 8/1988 | Fisher et al. |
| D297,597 | S | 9/1988 | Simpkins et al. |
| 4,796,846 | A | 1/1989 | Meier et al. |
| 4,805,365 | A | 2/1989 | Bastian |
| D300,657 | S | 4/1989 | Simpkins et al. |
| 4,819,569 | A | 4/1989 | Bastian et al. |
| 4,821,350 | A | 4/1989 | Feldt |
| D300,997 | S | 5/1989 | Simpkins et al. |
| 4,826,117 | A | 5/1989 | Bastian et al. |
| 4,826,221 | A | 5/1989 | Harmon |
| D301,925 | S | 6/1989 | Simpkins et al. |
| 4,846,431 | A | 7/1989 | Pflieger |
| 4,852,941 | A | 8/1989 | Jones |
| 4,858,260 | A | 8/1989 | Failor et al. |
| 4,865,303 | A | 9/1989 | Hall |
| 4,872,656 | A | 10/1989 | Brendgord et al. |
| 4,872,657 | A | 10/1989 | Lussi |
| 4,905,266 | A | 2/1990 | Kuck et al. |
| 4,913,413 | A | 4/1990 | Raab |
| 4,916,725 | A | 4/1990 | Quinter et al. |
| 4,937,902 | A | 7/1990 | Ceike Shapiro |
| 4,956,592 | A | 9/1990 | Schulte et al. |
| 4,958,816 | A | 9/1990 | Chaney et al. |
| 4,961,610 | A | 10/1990 | Reeder et al. |
| 4,966,351 | A | 10/1990 | Klepacki |
| 4,968,013 | A | 11/1990 | Kuck |
| 4,973,034 | A | 11/1990 | Michele |
| 4,989,848 | A | 2/1991 | Monroe |
| 4,995,067 | A | 2/1991 | Royster et al. |
| 4,996,731 | A | 3/1991 | Kruyt |
| 5,005,667 | A | 4/1991 | Anderson |
| 5,016,268 | A | 5/1991 | Lotman |
| D319,158 | S | 8/1991 | Jones et al. |
| 5,037,053 | A | 8/1991 | Fox et al. |
| D321,097 | S | 10/1991 | Jones et al. |
| 5,078,349 | A | 1/1992 | Smith |
| 5,081,808 | A | 1/1992 | Bastian et al. |
| 5,084,927 | A | 2/1992 | Parkevich |
| D326,381 | S | 5/1992 | Heiligenthal et al. |
| 5,157,787 | A | 10/1992 | Donnellan et al. |
| D330,771 | S | 11/1992 | Chaney et al. |
| D330,813 | S | 11/1992 | Spitzer et al. |
| 5,166,968 | A | 11/1992 | Morse |
| 5,203,135 | A | 4/1993 | Bastian |
| D335,409 | S | 5/1993 | Kellems |
| 5,208,928 | A | 5/1993 | Kuck et al. |
| 5,223,229 | A | 6/1993 | Brucker |
| 5,231,719 | A | 8/1993 | Schnelle |
| D341,737 | S | 11/1993 | Shepherd |
| 5,269,326 | A | 12/1993 | Verrier |
| 5,279,011 | A | 1/1994 | Schnelle |
| D344,802 | S | 3/1994 | Kuck et al. |
| D345,266 | S | 3/1994 | Koguma |
| 5,329,657 | A | 7/1994 | Bartley et al. |
| 5,339,750 | A | 8/1994 | Smies |
| 5,345,632 | A | 9/1994 | Langenaeken et al. |
| 5,348,375 | A | 9/1994 | Steininger |

5,369,825 A 12/1994 Reesby
5,369,827 A 12/1994 Parke et al.
5,403,549 A 4/1995 McNeil et al.
5,426,795 A 6/1995 Harty
D361,438 S 8/1995 Spencer et al.
D365,224 S 12/1995 Pohlman
5,472,270 A 12/1995 Czarnecky et al.
5,496,105 A 3/1996 Czarnecky et al.
5,507,050 A 4/1996 Welner
D370,572 S 6/1996 Lin
5,528,782 A 6/1996 Pfeuffer et al.
5,538,215 A 7/1996 Hosey
5,564,662 A 10/1996 Lussi et al.
5,564,663 A 10/1996 Cook et al.
5,565,834 A 10/1996 Hanley et al.
5,568,209 A 10/1996 Priester et al.
5,568,817 A 10/1996 Harty
D378,961 S 4/1997 Nordstrom et al.
D379,409 S 5/1997 Schwaegerle et al.
5,628,078 A 5/1997 Pennington et al.
5,638,644 A 6/1997 Bastian
5,645,313 A 7/1997 Best et al.
5,655,238 A 8/1997 Stickley et al.
5,660,405 A 8/1997 Campbell
5,661,859 A 9/1997 Schaefer
5,678,267 A 10/1997 Kinder
5,680,957 A 10/1997 Liu
D386,634 S 11/1997 Daugs
5,689,999 A 11/1997 Wiley et al.
5,706,678 A 1/1998 Sasaki
5,754,997 A 5/1998 Lussi et al.
5,771,513 A 6/1998 Kirchgeorg et al.
5,781,943 A 7/1998 Moenning et al.
5,855,207 A 1/1999 Moenning et al.
5,860,899 A 1/1999 Rassman
D404,945 S 2/1999 Simpkins et al.
D408,537 S 4/1999 Stickley et al.
D408,538 S 4/1999 Simpkins et al.
D408,539 S 4/1999 Simpkins
5,913,773 A 6/1999 Cox
5,919,131 A 7/1999 Smoler et al.
5,924,960 A 7/1999 Cohen
5,926,876 A 7/1999 Haigh et al.
5,953,773 A 9/1999 Asada et al.
D417,098 S 11/1999 Teufel et al.
D417,571 S 12/1999 Teufel et al.
D418,225 S 12/1999 Simpkins et al.
D420,225 S 2/2000 Lamb et al.
6,023,800 A 2/2000 Stickley
6,038,718 A 3/2000 Pennington et al.
6,073,284 A 6/2000 Borders
D428,629 S 7/2000 Cohen
6,101,652 A 8/2000 Matern, Jr.
6,106,065 A 8/2000 Carroll
6,115,978 A 9/2000 Bastian et al.
6,131,214 A 10/2000 Moenning et al.
6,173,461 B1 1/2001 Alexander
6,202,230 B1 3/2001 Borders
6,209,463 B1 4/2001 Koharchik et al.
6,212,713 B1 4/2001 Kuck et al.
6,230,343 B1 5/2001 Buiskool et al.
6,237,172 B1 5/2001 Morgan, Sr.
6,240,579 B1 6/2001 Hanson et al.
6,256,812 B1 7/2001 Bartow et al.
6,264,006 B1 7/2001 Hanson et al.
6,276,012 B2 8/2001 Borders
6,289,537 B1 9/2001 Hopper et al.
6,295,671 B1 10/2001 Reesby et al.
6,345,193 B2 2/2002 Dutto et al.
6,351,678 B1 2/2002 Borders
6,353,949 B1 3/2002 Falbo
6,363,555 B1 4/2002 LaRose
6,374,133 B1 4/2002 Dutto et al.
6,382,725 B1 5/2002 Carroll
D458,780 S 6/2002 Siepmann et al.
D461,899 S 8/2002 Siepmann et al.
D461,900 S 8/2002 Siepmann et al.
D462,189 S 9/2002 Brockway et al.
D462,445 S 9/2002 Barde et al.
D462,674 S 9/2002 Siepmann et al.
D463,861 S 10/2002 Siepmann et al.
6,505,364 B2 1/2003 Simmons et al.
D473,312 S 4/2003 Cook
6,546,577 B1 4/2003 Chinn
6,550,084 B2 4/2003 Siepmann et al.
6,568,008 B2 5/2003 Siepmann et al.
6,638,299 B2 10/2003 Cox
6,651,279 B1 11/2003 Muthuvelan
6,659,556 B2 12/2003 Pellerin
6,678,908 B2 1/2004 Borders et al.
6,681,423 B2 1/2004 Zachrisson
6,739,006 B2 5/2004 Borders et al.
6,754,923 B2 6/2004 Borders et al.
6,769,145 B1 8/2004 Pfeuffer et al.
D496,462 S 9/2004 Walters et al.
6,802,564 B2 10/2004 Brockway et al.
6,832,398 B2 12/2004 Borders et al.
6,857,147 B2 2/2005 Somasundaram
6,886,199 B1 5/2005 Schwaegerle
6,886,200 B2 5/2005 Blyshak et al.
6,926,366 B2 * 8/2005 Wolters ..... 297/423.36
2001/0000363 A1 4/2001 Borders
2001/0003789 A1 6/2001 Dutto et al.
2002/0000008 A1 1/2002 Borders
2002/0170115 A1 11/2002 Borders et al.
2002/0170116 A1 11/2002 Borders et al.
2003/0061662 A1 4/2003 Strobel et al.
2003/0071503 A1 4/2003 Brockway et al.
2003/0074735 A1 4/2003 Zachrisson
2003/0145383 A1 8/2003 Schwaegerle
2004/0068797 A1 4/2004 Smith et al.
2004/0074002 A1 4/2004 Bannister
2004/0074003 A1 4/2004 Bannister
2004/0098804 A1 5/2004 Varadharajulu et al.
2004/0133979 A1 7/2004 Newkirk et al.
2004/0172756 A1 9/2004 Somasundaram
2004/0172757 A1 9/2004 Somasundaram
2005/0015878 A1 1/2005 Bannister et al.

* cited by examiner

LEG REST AND KNEELER ASSEMBLY FOR A MEDICAL EXAMINATION TABLE

RELATED APPLICATION

This application claims the benefit of co-pending Provisional Patent Application Ser. No. 60/506,989, filed 29 Sep. 2003.

BACKGROUND OF THE INVENTION

The present invention relates to adjustable medical examination equipment and, more specifically, to an adjustable leg rest and kneeler assembly.

Adjustable footrests and kneelers for medical examination chairs and tables are well known in the art, but generally are elaborate in design or do not change from one position to another easily. The footrests usually require the steps of adding or removing one or more attachments to accomplish positional movement, which can be burdensome. Likewise, some designs that do not need the addition or removal of attachments do not allow for smooth movement between different positions.

For instance U.S. Pat. No. 4,958,816 discloses a leg and foot support assembly that is adjusts into different positions. However, the assembly has many interacting parts that do not always allow for the easiest transition from one position to another. The prior art guide rail used for extending the leg assembly has indents along the length of the guide rail, which are used to adjust and secure the assembly at different lengths. The indents provide a ratcheting action, which makes adjustment of the assembly tedious and also wears away the working parts over time, thereby diminishing the overall effectiveness of the assembly. Also, the guide area used to adjust the vertical and horizontal sections of the assembly relative to one another is designed with at least one sharp right angle, which does not provide for easy sliding movement of the relative sections of the assembly. Thus, an assembly is needed that will be easily arranged and adapted into different configurations in a smooth manner and process.

SUMMARY OF THE INVENTION

The present invention is a leg rest extension assembly for use on an examination table or chair. The extension assembly is normally in a horizontal position, aligned in the same plane as that of the examination surface of the table. The assembly may be extended outwardly from the table surface to extend the length of the available table surface. The assembly, which generally comprises a frame and an extension section that is slidably connected to the frame within a guide rail, is easily pulled outward away from the examination table to lengthen the surface. Latching means, located between the frame and the extension section, allow the assembly to be locked in predetermined extended positions. The latching means are designed and arranged in a separate location from the guide rail area, which allows for a simpler and more efficient design overall, since the sliding purpose of the guide rail does not have to be compromised to also act as a latching system.

The assembly may also be arranged to serve as a kneeler or kneeling section. An actuator connected to the table and the assembly allows the frame to be moved into any position between a vertical position and a horizontal position with respect to the examination table. The extension section may then be slidably moved into a position perpendicular to the frame, thereby forming the kneeler. Protuberances on the end of the extension section may interact with notched areas located on the guide rail and hold the extension section in a kneeling position. The assembly allows for the extension section to be positioned at different heights with respect to the frame, thereby accommodating people of different heights.

The guide rails that the extension section slides within are designed in an efficient manner so as not to require unnecessary bearing elements that may prevent smooth movement of the extension section.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention.

Figure 1:
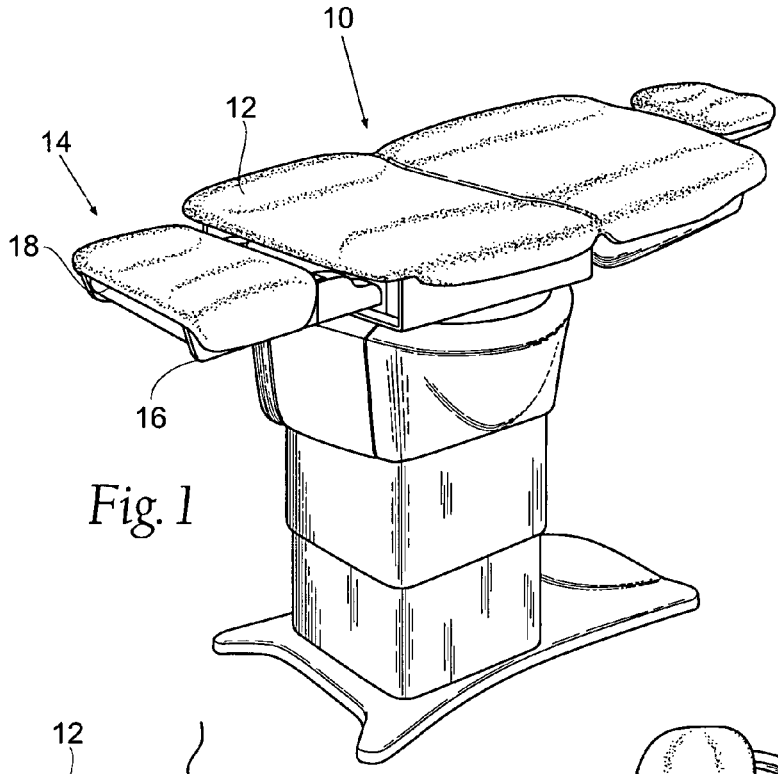
FIG. 1 is a perspective view of an adjustable examination table/chair including the leg rest assembly of the present invention.

FIG. 1 is a perspective view of a stationary support 10 including a support surface 12 and a leg rest assembly 14.

For clarity the stationary support 10 will be referred to as a table, but it is understood that the present invention could be used in connection with a chair, table, bed, or similar piece of furniture. The leg rest assembly 14 allows for the table 10 to be adjusted into a wide range of sitting, kneeling, and lying positions. The leg rest assembly 14 has two main sections, a frame 16 and an extension section 18. The frame 16 can include any structure that will provide a support base for further movement of the extension section 18. The frame 16 slidingly supports the extension section 18 and is pivotally attached to the examination table 10. The leg rest assembly 14 allows for the extension section 18 to be brought closely to the support surface 12, with a minimal gap between the extension section 18 and the examination table 10.

Figure 1A:
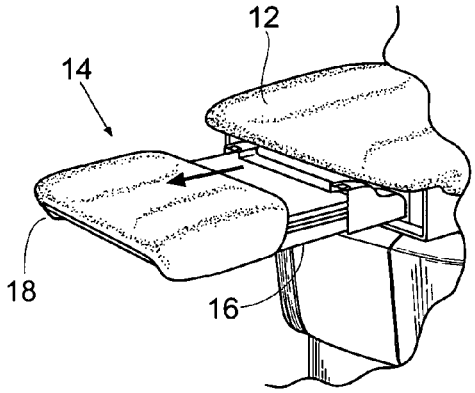
FIG. 1A is a cut-away perspective view of the examination table of FIG. 1 with an extended leg rest section.

FIG. 1A is a cut-away perspective view of the examination table 10 with the leg rest assembly 14 in an extended position, thereby allowing the table 10 to be adjusted to support people of varying heights. When in an extended position, the extension section 18 may be releasably secured to the frame 16, as will be discussed more particularly with respect to FIGS. 8A and 8B. As will be discussed further, the present invention provides for adjustment of the examination table 10 and extension of the leg rest assembly 14 in a more user-friendly manner than previous prior art designs and also in a manner that also minimizes wear on the interacting parts of the leg assembly 14, thereby extending the effective life of the leg assembly 14.

Figure 2:
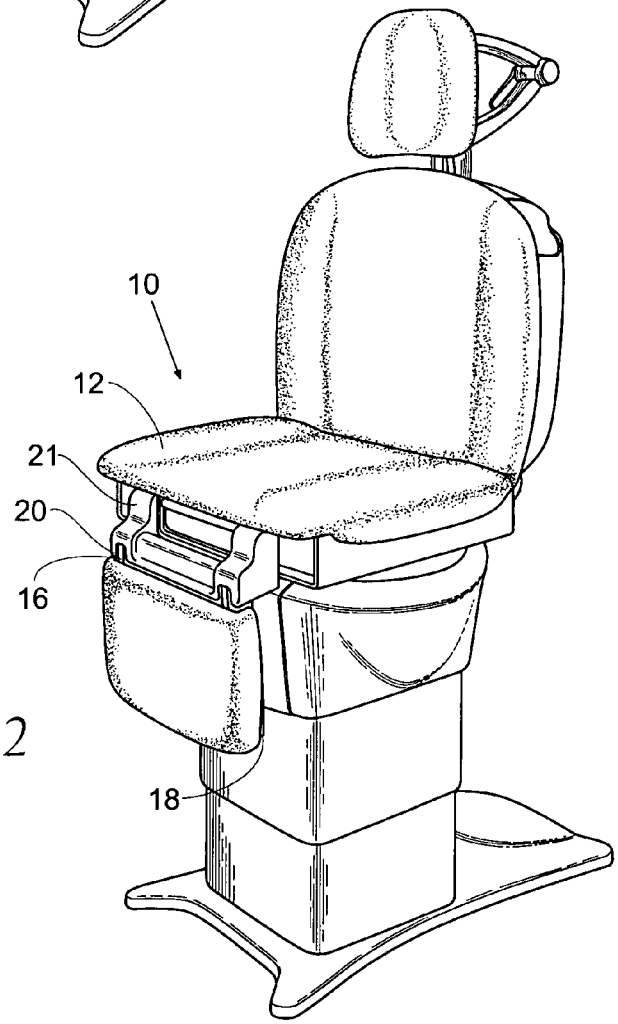
FIG. 2 is a perspective view of the examination table of FIG. 1 arranged as an examination chair.

FIG. 2 shows a perspective view of the examination table 10 configured as a chair. The frame 16 and the extension section 18 are pivoted downwardly from the support surface 12. A proximal end 20 of the frame 16 is pivotally attached to the table 10 by way of a brace 21. The contour of the proximal end 20 allows it to be pivoted under the support surface 12. This provides for an overall more compact and aesthetically pleasing table 10, as the extension section 18 and the support section 12 may be arranged with a minimal gap between them. The proximal end 20 could be attached directly to the table 10, but the shown arrangement, including the brace 21, allows for smoother movement of the leg assembly 14 with respect to the support surface 12.

Figure 3:
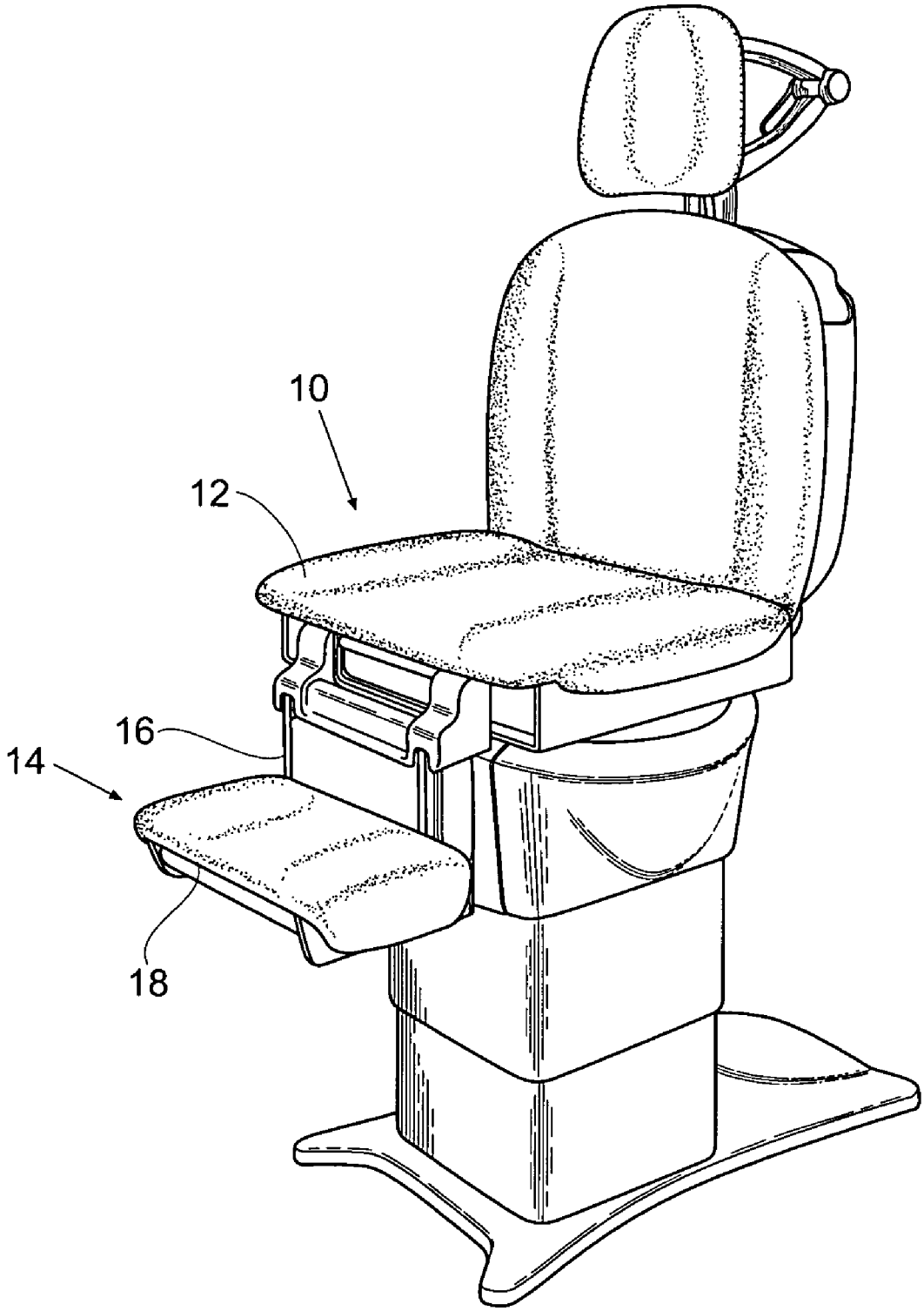
FIG. 3 is a perspective view of the examination table showing the leg rest arranged as a kneeler.

FIG. 3 shows a perspective view of the table 10 having the assembly 14 arranged in a kneeling position. The extension section 18 is perpendicular to the frame 16 in a lowered position. The extension section 18 is shown parallel to the support surface 12; however, the assembly 14 allows for positioning of the extension section 18 anywhere between a parallel position relative to the support surface 12 and a perpendicular position relative to the support surface 12.

Figure 4A:
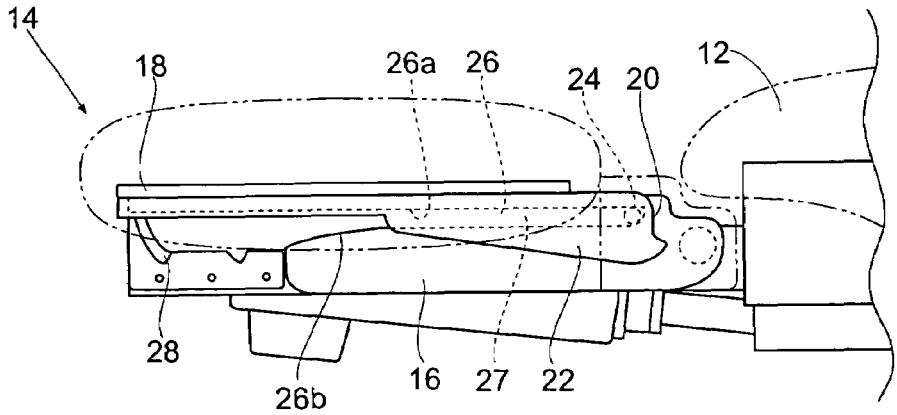
FIG. 4A is a close-up side elevation view of the leg rest assembly of the present invention.

FIG. 4A is a side view of the assembly 14 residing in the same vertical plane as the support surface 12. The extension section 18 has an arm 22 located on each side of the extension section 18. The arms 22 are oppositely disposed of one another. Only one side is shown since the sides and arms 22 of the extension section 18 are like parts. The arm 22 is connected to a slidable bearing means 24, which allows the arm 22 to be slidingly and pivotally connected to a guide rail 26 located in the frame 16. The guide rail 26 has an interior surface 26*a* and an exterior surface 26*b*. The guide rail 26 comprises a guide slot 27. The guide slot 27 provides an area for the slidable bearing means 24 to connect the arm 22 to the guide rail 26 and preferably with the end 28 defining a stop so that the bearing means 24 will not be slide completely out of the guide slot 27. The slidable bearing means 24 may be of any suitable design that will allow the extension section 18 to smoothly slide relative to the frame 16. Preferably, the slidable bearing means 24 are located completely within the guide slot 27 on the interior surface 26*a* of the guide rail 26. This protects the slidable bearing means 24 from being worn away by external elements, such as dust or dirt, for which the slidable bearing means 24 would be more susceptible to attract if the slidable bearing means 24 were located on the exterior surface 26*b* of the guide rail 26. The guide slot 27 extends generally the length of the frame 16 and ends at a distal end 28 of the frame 16. The guide slot 26 is approximately as wide as the slidable bearing means 24 near the proximal end 20 and expands at the distal end 28. The widening of the guide slot 26 allows the extension section 18 to be rotated and positioned as a kneeler (see FIG. 3).

As shown and discussed, the present invention is preferably designed with oppositely disposed arms 22 and guide rails 24. However, the present invention may be designed with a single guide rail 26 and arm 22, possibly centrally located of the frame 16 and the extension section 18. Likewise, the arrangement of the guide rails, guide slots, and arms may be reversed. That is, the guide rails 26 may be located on the extension section 18, thereby providing a guide slot for the frame 16. Provided a guide area allows for smooth slidable motion between the frame and extension section, it is understood that the guide area would fall within the scope of the present invention. Similarly, further discussion of movement of the extension section 18 with respect to the frame 16 also includes respective movement of the frame 16 to the extension section.

Figure 5:
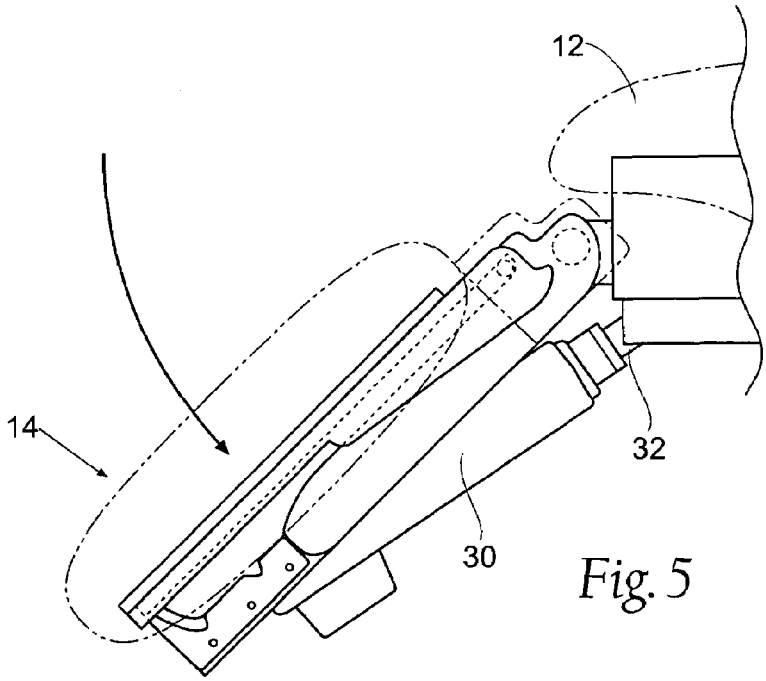
FIG. 5 shows the assembly of FIG. 4B in a declining position.

FIG. 5 is a close-up side view of the assembly 14 angled downwardly from the support surface 12. An actuator 30 is employed to pivot the assembly 14 relative to the support surface 12. The actuator 30 controls a piston 32, which provides for smooth movement of the assembly 14 to a desired position or angle. The actuator 30 allows the piston 32 to be stopped at any position between near vertical and horizontal. The actuator may be comprised of a pneumatic piston-style device, push-only actuator, gas spring actuator, cable, or another mechanical pneumatic or hydraulic device. Any device that allows the assembly 14 to pivot and be secured in a new or different position should be considered as an actuator for the purpose of the present invention, including manual or automatic devices.

Figure 6:
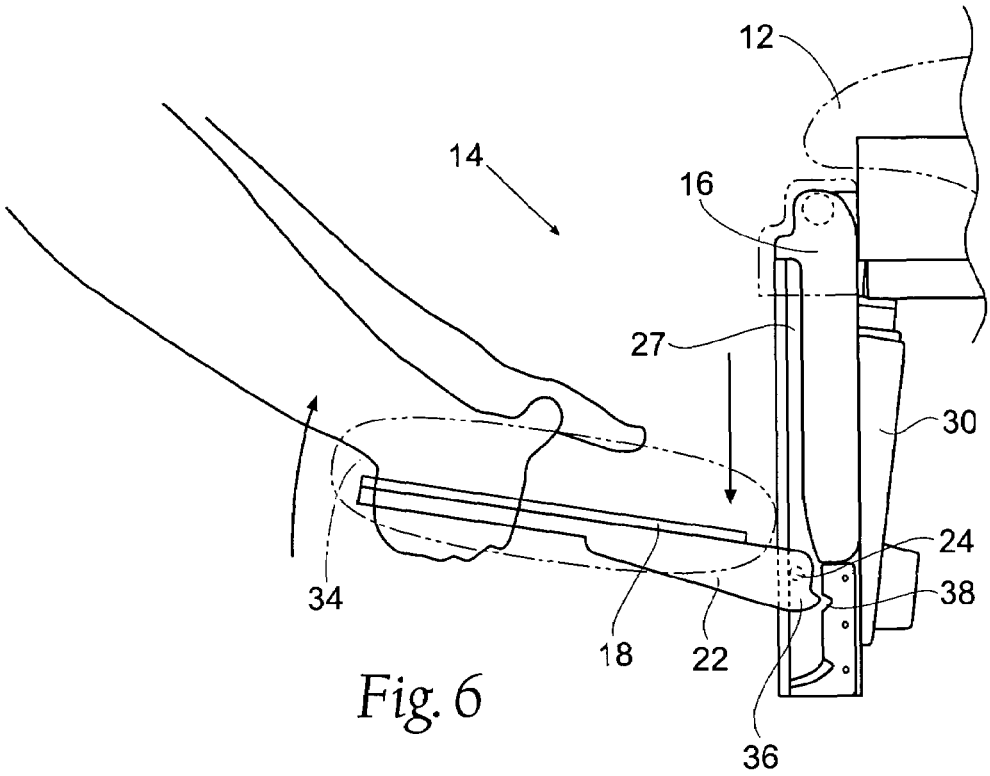
FIG. 6 shows the assembly of FIGS. 4B & 5 being adjusted into the kneeler position.

FIG. 6 is a close-up side view of the assembly 14 adjusted to serve as a kneeler. The actuator 30 drives the frame 16 into a perpendicular position with respect to the support surface 12. A person moves the extension section 18 by grasping a pad 34 that covers the extension section 18. The pad 34 may be attached to the extension section 18 in any sufficient manner, or may be designed as integral piece with the extension section 18. As shown in the drawings, the pad 34 is designed so that the sides of the pad 34 come down over the guide rails 26. This forms a handle for the user to grasp the extension section 18, and forms a further barrier between the patient and the extension section 18 and the frame 16 for added comfort and safety. The pad 34 is shown in phantom so that the extension section 18 may be shown in the drawing.

Still referring to FIG. 6, once the extension section 18 and the slidable bearing means 24 are slid to the area where the guide rail 26 widens, the extension section 18 may be rotated upwardly. When this happens, a protuberance 36 located on the arm 22 may engage a notch 38 located in the guide rail 26. There may be several notches 38 located along the guide rail 26. The notches 38 are positioned and arranged along the guide rail 26 so that the notches 38 do not interfere with the movement of the slidable bearing means 24. Likewise, the notches 38 are positioned so that they will not catch the protuberance 36 unless the user specifically moves the arm 22 so the protuberance 36 engages one of the notches 38. After the protuberance 36 engages the notch 38, the extension section 18 and the pad 34 will be held firmly in a position perpendicular to the frame 16, thereby forming a kneeler. If the assembly 14 is no longer needed to act as a kneeler, the extension section 18 may be pivoted upwardly, which will free the protuberance 36 from the notch 38 and the extension section 18 may then be rotated to engage another notch 38 or moved into a parallel position to the frame 16. The preferably curvilinear shape of the protuberance 36 allows for smooth transition of the extension section 18 from one position to another, but other shapes for the protuberances are possible as well. As shown in the drawings, the shape of the protuberance 36 and the notches 38 are dimensioned for easy adjustment of the extension section 18, while still allowing for the extension section 18 to form a secure kneeler. Likewise, the interior surface 26*a* of the guide rail 26 (see FIGS. 4A and 4B) does not have any sharp angles or corners along the path that may prove difficult for the user to navigate the slidable bearing means 24.

Figure 7:
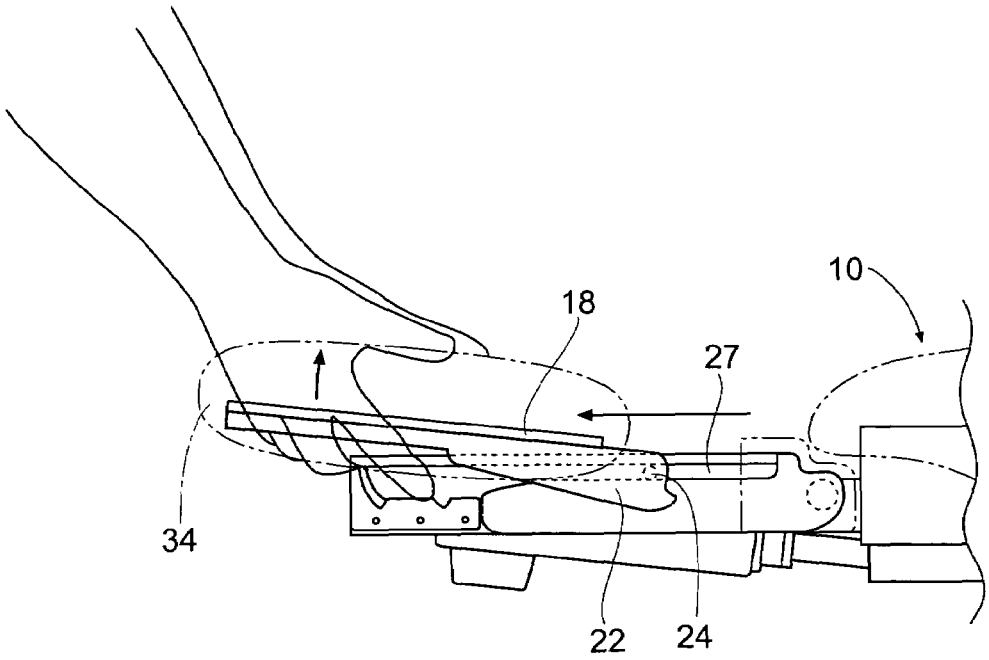
FIG. 7 shows the assembly of FIG. 4B being extended outwardly from the examination table.

FIG. 7 is a cut-away side view of the extension section 18 being pulled away from the table 10. If the overall length of the table needs to be extended, such as for a tall patient, the user grasps the pad 34 and pulls outwardly from the table 10. The user may also pull the pad 34 upwardly at the same time as pulling outwardly, thereby preventing the extension section 18 from ratcheting against a locking or latching section 40 (see FIG. 8). Once the desired predetermined length is reached, the user may latch the extension section 18 securely into place. As the extension section 18 is being pulled outwardly, the slidable bearing means 24 allow the extension section 18 to slide smoothly with respect to the frame 16. The movement is the same as described previously with respect to FIG. 6. Because the latching means are not located within or as part of the guide rail 26, movement of the arm 22 is smoother than previous designs, which makes adjustment of the leg assembly 14 easier and also wears less on the interacting parts of the assembly 14.

As a further advantage over the prior art, the symmetrical arrangement of the bearing means 24 within the guide slots 27 provides a smoother, easier to use assembly. That is, the bearing means 24 located in one guide slot 27 are preferably located at the same position with respect to the guide slot 27 as the bearing means 24 in the other guide slot.

As stated above regarding FIG. 6, the guide rail 26 widens towards the distal end 28 of the frame, allowing the protuberance 36 to be secured in the notch 38 when the extension section 18 is pivoted. Though the guide rail 26 is approximately as wide as the slidable bearing means 24 near the proximal end 20 of the frame 16, the extension section 18 may still be pivoted around the slidable bearing means 24 within the guide rail 26; the protuberance 36, however, will not have an area to lock the extension section 18 into place.

Figure 4B:
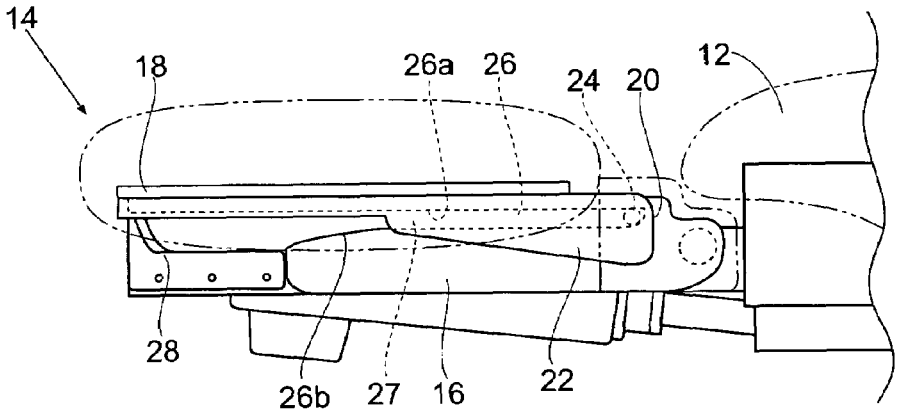
FIG. 4B is a close-up side view elevation of another embodiment of the present invention.

FIG. 4B shows another embodiment of the leg assembly 14. It may not be a necessary feature for some users that the tale 10 is adjustable as a kneeler. Designing the arm 22 without the protuberance 36 and designing the guide rail 26 without the notch or notches 38 may then simplify the design of the assembly 14. This embodiment will still provide for smooth sliding movement of the leg assembly 14, and the leg assembly 14 may still be secured in extended positions. This is an improvement over prior art designs that do not allow for a smooth guide rail, if the table is to be locked in extended positions from the main examination table. As shown in FIG. 4B, the shape of the arm 22 may vary and still fall within the scope of the present invention.

Figure 8A:
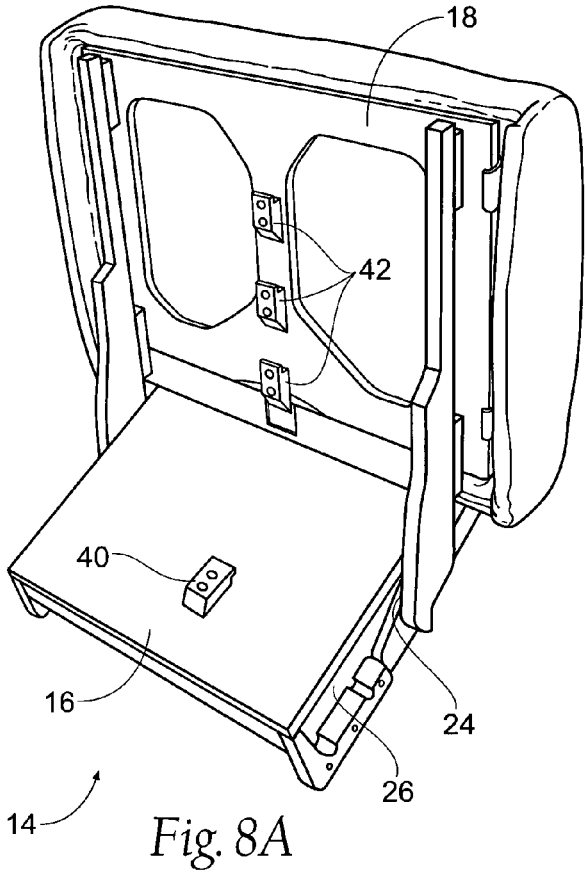
FIG. 8A shows a perspective view of the assembly with the leg rest pivoted outwardly from the assembly frame.

FIG. 8A shows a perspective view of the leg assembly 14 with extension section 18 pivoted away from the frame 16. The extension section 18 will generally not be pivoted away from the frame 16 as far as shown in FIG. 8A, but is shown as such to view the latching means of the invention. The latching section 40 is preferably located on the frame 16, equidistant from the sides of the frame 16. A latching section 40 is aligned with a plurality of latches 42 that allow the extension section 18 to be removably secured to the frame 16. There may be more than one set of latching sections and latches located on the frame 16, and the latching section 40 and the latches 42 may be of different dimensions of those shown in FIG. 8. Because the latching section 40 and the latches 42 are in a separate location on the assembly from the guide rails 26 and the slidable bearing means 24, latching or securing structures will not impede movement and extension of the extension section 18, and the extension section 18 may glide smoothly with respect to the frame 16. It is also possible two have two or more independent latching sections 40 and latches 42 that may be used to secure the assembly 14 in an extended position.

Figure 8B:
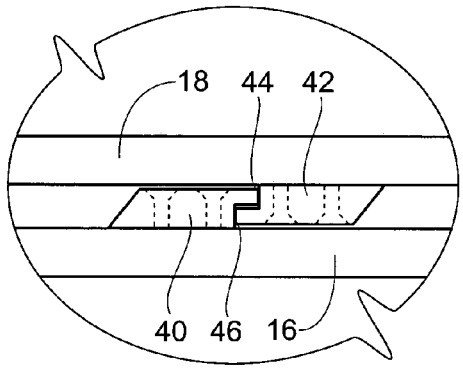
FIG. 8B is a close-up partial side elevation view of a latching assembly according to the present invention.

FIG. 8B shows a close-up side view of the latching section 40 interacting with one of the latches 42. A first ledge 44 located on the latch 42 will slide under a second ledge 46 the latching section 40. Preferably the first ledge 44 is symmetrical to the second ledge 46, and preferably the latching section 40 and the latch 42 are symmetrical. A symmetrical design simplifies the manufacturing process, since fewer differently designed parts are necessary for assembly.

As previously noted in describing FIG. 8, the separate placement and arrangement of the latching means and the guide means of the assembly 14 provides a more durable, user-friendly design over the prior art. For instance, prior art devices that incorporate notches or cutout sections in the guide rail to provide for a latching mechanism do not provide for smooth movement and extension of the leg or foot assembly. In such an arrangement, the bearing means will ratchet against the notches or cutouts as the assembly is extended, which not only prevents smooth adjustment of the assembly, but also results in unnecessary wear on the guide rail and bearing means. The separation between the latching means and the guide means of the present invention reduces wear on these sections, resulting in an extended useful life for the leg assembly 14. Also, a separate structure provides for locking of the assembly, which increases the strength of a locked, extended position for the assembly.

Figure 9:
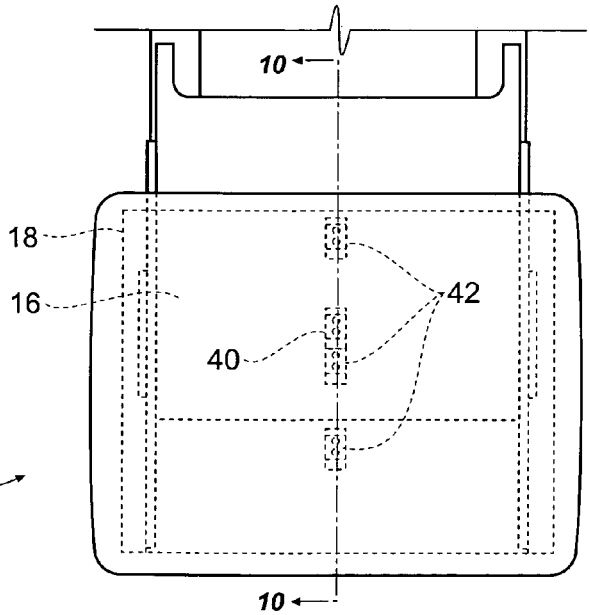
FIG. 9 is top plan view of the assembly in an extended position.

FIG. 9 shows an overhead view of the leg assembly 14. The frame 16, along with the latching section 40 and the latches 42, is shown in phantom. The latching section 40 and the latches 42 are securely interacting with one another. The arrangement allows for the frame 16 and the extension section 18 to be secured together, regardless of the angle with respect to the ground that the leg assembly is positioned. This is further accomplished without further retention means or devices being necessary to keep the assembly 14 in the desired position.

Figure 10:
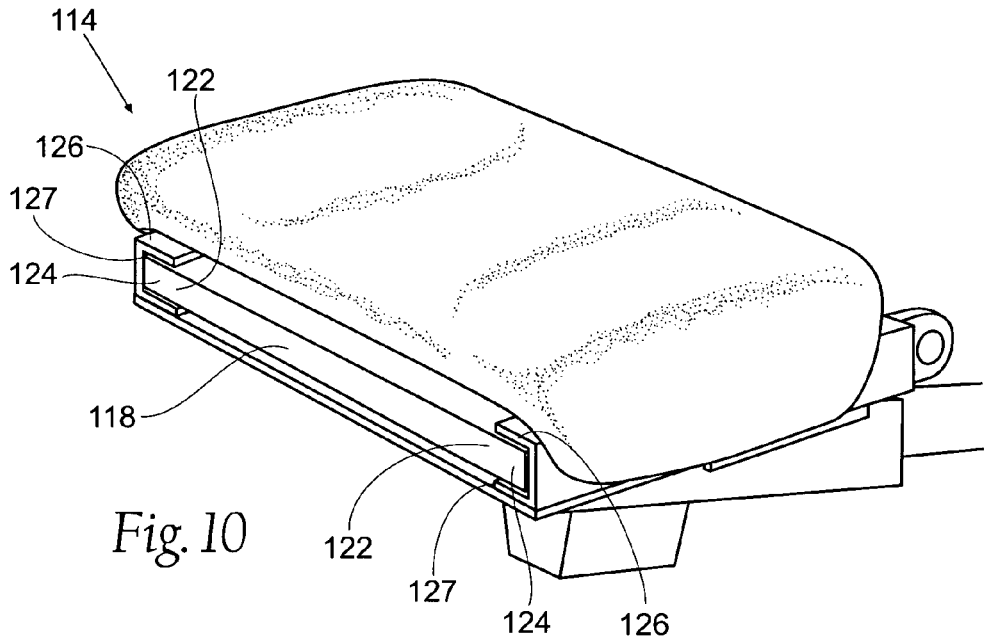
FIG. 10 is a front perspective view of a support assembly in accordance with the present invention.

FIG. 10 shows a front perspective view of another embodiment of a leg rest assembly 114 according to the present invention. The assembly 114 is generally similar to the assembly 14. The assembly 114 consists of a frame 116 and an extension section 118. The frame 116 supports the extension section 118 and is pivotally attached to the examination table 10. The extension section 118 has oppositely disposed arms 122 located on each side of the extension section 118. The arm 122 is connected to a slidable bearing means 124. The slidable bearing means 124 slidingly interact with guide rails 126 located on the frame 116. Each of the guide rails 126 comprises a guide slot 127, which provides an area for the slidable bearing means 124 to rest and slide. As compared to the previous embodiments of the leg assembly, the guide rails 126 are located on the inside side of the frame 116, as opposed to the outside of the frame 116. The inside arrangement further protects the slidable bearing means 124 and the guide rails 126 from dirt or other materials, and further prevents the users hands to come in contact with the slidable bearing means 124 and the guide rails 126.

Figure 11:
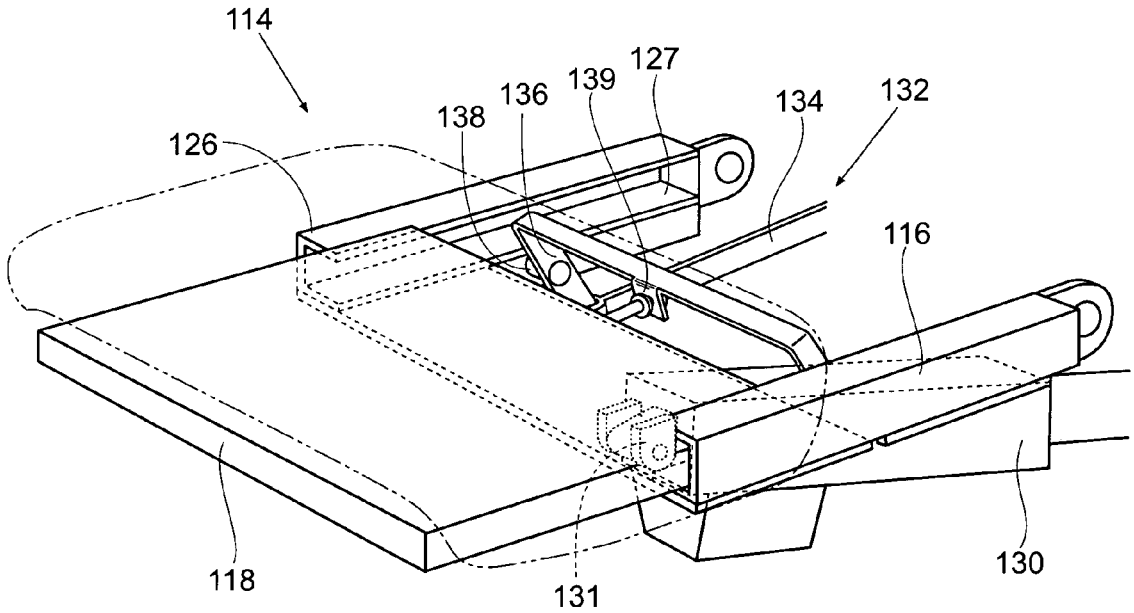
FIG. 11 is a front perspective view of another embodiment of a support assembly according to the present invention.

FIG. 11 shows a further perspective view of the leg assembly 114. The extension section 118 is shown in an extended position. An actuator 130 allows for pivotal movement of the frame 116 and the extension section 118 with respect to the table 10. The actuator 130 may be attached to the frame 118 by way of attachment means 131, such as a U-bolt and pin, that will secure the actuator to the extension section. As previously noted, the actuator 130 may be of any design or device that assists in movement of the extension section 118, specifically, and the leg assembly 114. It is also understood that the actuator 130 does not necessarily need to be an automatic device, and pivotal movement of the extension section 118 and the frame 116 may be performed manually.

FIG. 11 also shows a second actuator 132 comprised of a first linkage 134 and a second linkage 136. The first linkage 134 is attached to the table (not shown), and the second linkage 136 is attached to a pivot 138, which may rest on the guide rail 126. If the second actuator 132 is used, as shown in FIG. 11, the second actuator 132 may also act as latching means 139 for the assembly 114. Similar to the latching section 40 and latches 42, the second actuator 132 will hold the extension section 118 in different extended positions with respect to the examination table 10 and the frame 116. Thus, the extension section could be arranged with one or two actuators, with either of the actuators acting as the latching mechanism for the leg assembly, and the latching mechanism could be designed as an automatic device.

As can be seen in FIGS. 10-11, the slidable bearing means 124 comprise a more rigid structure than the slidable bearing means 24 shown in the previous embodiments. Likewise, the slidable bearing means 124 are integral extensions of the arms 122. Provided that a bearing or bearing means provides slidable support for an extension section with respect to a frame for a leg assembly, it us understood that the bearing means would fall within the scope of the present invention. Furthermore, the arms 122 could be located at any angle with respect to the extension section 118, and could even be considered integrally arranged with the extension section, considered as the marginal edges of the extension section 118.

Figure 12:
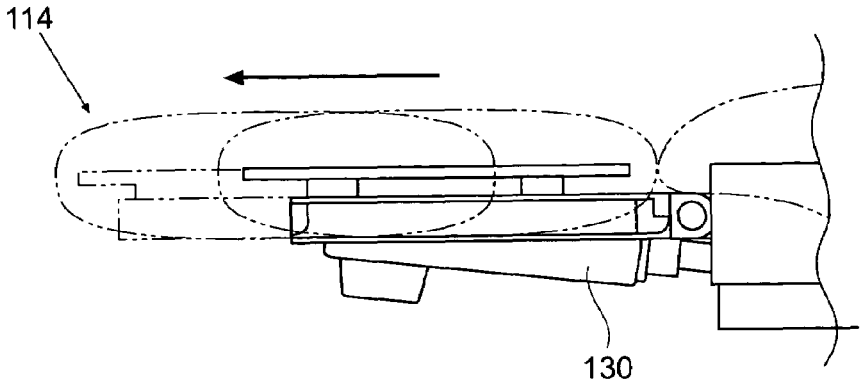
FIG. 12 is a side elevation view of the support assembly of FIG. 11.
Figure 13:
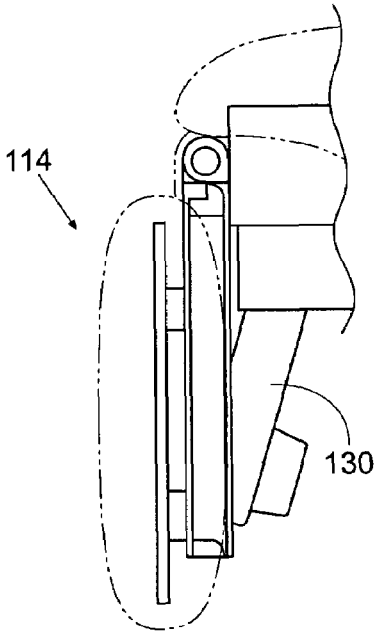
FIG. 13 is a side elevation view of the support assembly of FIG. 12 positioned perpendicular to the examination table.
Figure 14:
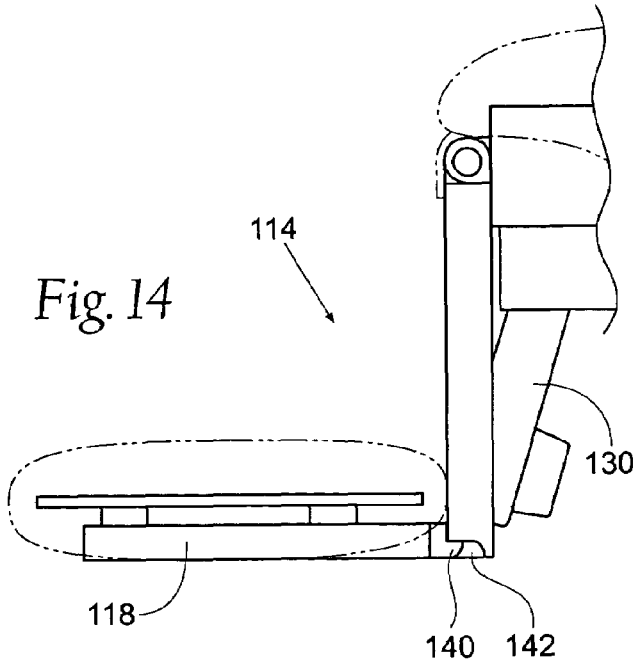
FIG. 14 is a side elevation view of the support assembly according to FIG. 3 positioned as a kneeler.

FIGS. 12-14 show elevation side views of the leg assembly 114. The figures show that the assembly 114 may be arranged in an extended position (FIG. 12) as a chair (FIG. 13) or as a kneeling section (FIG. 14), similarly to the assembly 14. Such movements may be controlled completely by the actuator 130, or may be accomplished manually, or may be a combination of manual and automatic means. Also, the second actuator 132 described with respect to FIG. 11, may be employed to assist in these movements. As in the previous embodiment, if desired, a protuberance 140 may interact with a notch 142 to secure the extension section 118 in a kneeling position (see FIG. 14).

Figure 15:
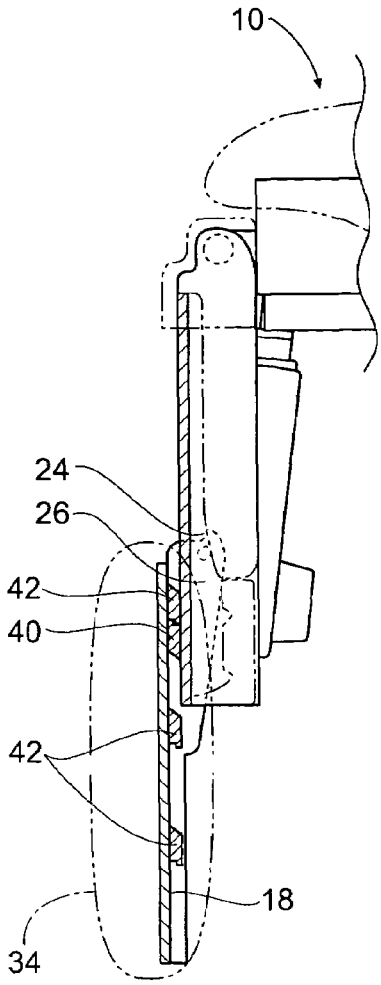
FIG. 15 is a side elevation view showing the locking mechanism when the assembly is being extended.

FIG. 15 shows a side elevation view of the extension section 18 and the pad 34 extended outwardly and downwardly from the table 10. As previously noted, the latching section 40 will be held in place by interacting with one of the plurality of latches 42. The latches 42 provide predetermined positions to outwardly extend the extension section 18. As noted with respect to FIG. 8B, the latching section 40 and the latched 42 are preferably shaped as generally symmetrical ramp shapes, which provides for an easy design, but also allows the latching section 40 to be efficiently held in place. The latches 42 are located in a separate area from the guide rail 26. This is an improvement over previous designed assemblies, which had bearing means also providing latching means for an extension section. Because the present invention does not require the slidable bearing means 24 to also latch the extension section 18 in an extended position, the slidable bearing means 24 and the guide rail 26 may be designed in a straightforward, concise manner, which provides for an assembly 14 that is operated more easily than prior art assemblies. While it is possible to reverse the arrangement of the latching section 40 and the latches 42, that is rearrange the positioning of the first ledge 44 and the second ledge 46 (see FIG. 8B), such an arrangement is generally not preferred. The shown design will benefit from the effects of gravity to secure the frame 16 and the extension section 18 when the assembly 14 is in a downwardly extended position.

Figure 16:
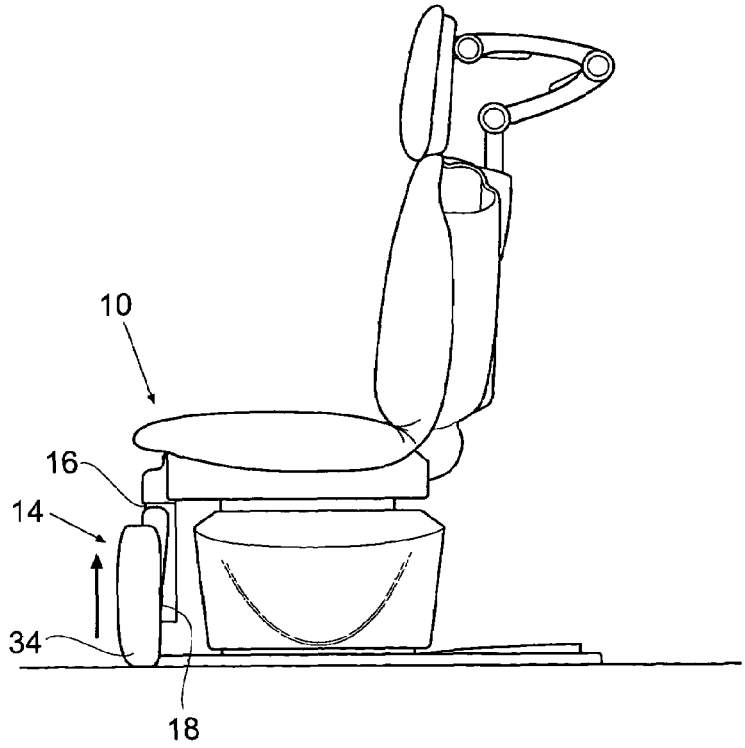
FIG. 16 is a side elevation view of the assembly & examination table/chair in contact with a floor.

It is generally not preferred during operation for the extension section 18 to be in an extended position from the table 10 when the section 18 is facing downwardly from the table 10. Because the table 10 may be independently moved up and down with respect to the extension section 18, the section 18 and the pad 34 may be inadvertently driven into a solid surface, such as a foot or floor. For instance, as shown in FIG. 16, the table 10 is in a lowered position (compare FIG. 16 with the height of the table 10 shown in FIGS. 1 and 2). If the extension section 18 were in the extended position described and shown in FIG. 10, the section 18 would come into contact with the floor, which could potentially cause damage to the extension section 18 or the floor. However, because of the design of the latching section 40 and the latches 42 (see FIG. 8), the extension section 18 will move upwardly from the floor when the pad 34 makes contact with the floor. Likewise, because of the design of the guide rails 26 and the slidable bearing means 24 (see FIG. 15), the assembly 14 may retract without damaging or wearing away the guide rails 26 and the slidable bearing means 24. The upward movement is made possible without the necessary use of any power means, which provides for a simpler and safer assembly than previous designs. The frame 16 is preferably designed of a height that is less than the height of the table 10 when the table 10 is in the most compact or lower most position, which will allow the assembly 14 to be in a kneeling position and still not contact the floor.

The assembly 14 is preferably designed from solid materials, such as hardened steels, that will resist wear and tear when the sections are sliding relative to one another. The pad 34 may be made of any material that will provide a relatively sturdy, comfortable support for a patient. As previously noted, the pad 34 acts not only to give comfort to the patient, but also as a barrier between the moving parts of the assembly 14 and the patient and examiner and, also, as a handle for grasping and adjusting the assembly 14.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. A leg and foot support assembly for an adjustable stationary support, said support assembly capable of moving between a position substantially parallel to said stationary support to a position substantially perpendicular to said stationary support, said assembly comprising:

a frame extending laterally relative to said support;

an extension section in slidable relationship with said frame, said extension section supported by said frame;

at least one guide rail, said guide rail having a longitudinally disposed guide slot substantially coextensive with said guide rail, said extension section in slidable relationship with said guide slot; and a latching assembly for securing said frame to said extension section, said latching assembly located separately from said guide rail, said latching assembly comprising at least one latch, said latch having a first portion and a second portion, each of said portions having a ledge arranged to interact with the ledge of the other said portion to secure said frame to said extension section, at least one of said latches having an inclined surface to allow disengagement of said latch when said extension section contacts an external object; and said latching assembly providing means for extending the length of said assembly when said support assembly is in said substantially parallel position.

2. The support assembly according to claim 1 further comprising an actuator for pivoting said assembly between substantially parallel position and said substantially perpendicular position.

3. The support assembly according to claim 1 wherein said latching assembly is capable of securing said assembly in place when in said substantially perpendicular position.

4. A leg and foot support assembly for an adjustable stationary support, said support assembly capable of moving between a position substantially parallel to said stationary support to a position substantially perpendicular to said stationary support, said assembly comprising:

a frame extending laterally relative to said support;

an extension section in slidable relationship with said frame, said extension section supported by said frame;

at least one guide rail, said guide rail having a longitudinally disposed guide slot substantially coextensive with said guide rail, said extension section in slidable relationship with said guide slot; and a latching assembly for securing said frame to said extension section, said latching assembly located separately from said guide rail, said latching assembly comprising:

an actuator connected to a linkage assembly;

said latching assembly connected to said extension section;

said linkage assembly providing movement of said extension section along said guide rail;

said latching assembly providing means for extending said extension section when said support assembly is in said substantially parallel position.

5. A leg rest assembly for an examination table, the leg rest assembly comprising:

a frame extending laterally relative to the examination table;

an extension section supported by the frame and in slidable relationship therewith;

at least one guide rail coupled to the frame, the guide rail having a guide slot, the extension section in slidable relationship with the guide slot; and a latching assembly configured to secure the frame to the extension section, the latching assembly located separately from the guide rail, the latching assembly comprising at least one latch, the latch having a first portion and a second portion, each of the portions having a ledge arranged to interact with the ledge of the other portion to secure the frame to the extension section, at least one of the latches having an inclined surface to allow disengagement of the latch when the extension section contacts an external object.

6. The leg rest assembly of claim 5 wherein the frame is configured to move between a position that is substantially parallel to the examination table and a position that is substantially perpendicular to the examination table, the extension section being configured to extend relative to the frame section when the frame section is in the substantially parallel position.

7. The leg rest assembly of claim 6 wherein at least one of the latches allows disengagement of the latch when the extension section contacts an external object when in the substantially perpendicular position.

8. The leg rest assembly of claim 6 further comprising an actuator configured to pivot the leg rest assembly between the substantially parallel position and the substantially perpendicular position.

9. The leg rest assembly of claim 6 wherein the latching assembly is configured to secure the leg rest assembly in place when in the substantially perpendicular position.

* * * * *